US005898415A

United States Patent [19]

Hansen et al.

[11] Patent Number: 5,898,415

[45] Date of Patent: Apr. 27, 1999

[54] CIRCUIT AND METHOD FOR CONTROLLING THE COLOR BALANCE OF A FLAT PANEL DISPLAY WITHOUT REDUCING GRAY SCALE RESOLUTION

[75] Inventors: Ronald L. Hansen, San Jose; Jay Friedman, Felton, both of Calif.

[73] Assignee: Candescent Technologies Corporation, San Jose, Calif.

[21] Appl. No.: 08/938,194

[22] Filed: Sep. 26, 1997

[51] Int. Cl.[6] ..... G09G 3/22

[52] U.S. Cl. ..... 345/74; 345/150

[58] Field of Search ..... 345/74, 75, 76, 345/77, 150, 211; 315/169.1, 169.3

[56] References Cited

U.S. PATENT DOCUMENTS

| | | | |
|---|---|---|---|
| 5,528,103 | 6/1996 | Spindt et al. | 313/497 |
| 5,559,389 | 9/1996 | Spindt et al. | 313/310 |
| 5,564,959 | 10/1996 | Spindt et al. | 445/24 |
| 5,578,899 | 11/1996 | Haven et al. | 313/422 |
| 5,607,335 | 3/1997 | Spindt et al. | 445/50 |
| 5,608,283 | 3/1997 | Twichell et al. | 313/309 |
| 5,708,451 | 1/1998 | Baldi | 345/75 |
| 5,825,134 | 6/1997 | Ito | 315/169.1 |

*Primary Examiner*—Mark K. Zimmerman
*Assistant Examiner*—Ronald Laneau
*Attorney, Agent, or Firm*—Wagner,Murabito&Hao

[57] ABSTRACT

A circuit and method for controlling the color balance of a flat panel display without losing gray scale resolution of the display screen. Within a FED screen, a matrix of rows and columns is provided and emitters are situated within each row-column intersection. Rows are activated sequentially by row drivers and corresponding individual gray scale information (voltages) is driven over the columns by column drivers. When the proper voltage is applied across the cathode and anode of the emitters, they release electrons toward a phosphor spot, e.g., red, green, blue, causing an illumination point. Within each column driver, a digital to analog converter that contains two data-in voltage-out transformation functions, a first function corresponding to a first voltage intensity and a second function corresponding to a lesser voltage intensity for a same digital color value. During the row on-time window, the present invention time multiplexes application of the voltages for the first and second functions when driving color information (e.g., voltages) over the column lines. There is a separate timing signal for each color that controls the multiplexing intervals. By adjusting the timing signal for a particular color, the intensities for all pixels of that color are adjusted up or down relative to the other colors. This provides an effective color balancing technique that does not require expansion of the color driver substrate area nor does it degrade the gray scale capability of the FED screen. Adjustment of color balancing can be done in response to tube aging and/or manufacturing variations in the phosphor.

20 Claims, 12 Drawing Sheets

CIRCUIT AND METHOD FOR CONTROLLING THE COLOR BALANCE OF A FLAT PANEL DISPLAY WITHOUT REDUCING GRAY SCALE RESOLUTION

BACKGROUND OF THE INVENTION

1. Field of the Invention

The present invention relates to the field of flat panel display screens. More specifically, the present invention relates to the field of flat panel field emission display (FED) screens.

2. Related Art

In the field of flat panel display devices, much like conventional cathode ray tube (CRT) displays, a white pixel is composed of a red, a green and a blue color point or "spot." When each color point of the pixel is excited simultaneously, white can be perceived by the viewer at the pixel screen position. To produce different colors at the pixel, the intensity to which the red, green and blue points are driven is altered in well known fashions. The separate red, green and blue data that corresponds to the color intensities of a particular pixel is called the pixel's color data. Color data is often called gray scale data. The degree to which different colors can be achieved within a pixel is referred to as gray scale resolution. Gray scale resolution is directly related to the amount of different intensities to which each red, green and blue point can be driven.

Field emission display (FED) screens, like CRT displays, utilize phosphor spots to generate the red, green and blue points of a pixel. Often, during the manufacturing process, the characteristics of the phosphor of the display screen for a particular color can vary from screen to screen. If the phosphor has different characteristics, then its color intensity will vary from screen to screen thereby producing screens with different color balance. Therefore, it is important that a display screen have a mechanism for altering the relative color intensities of the color points so that manufacturing variations in the phosphor can be compensated for in the display screen. The method of altering the relative color intensities of the color points across a display screen is called white balance adjustment (also referred to as color balance adjustment or color temperature adjustment).

Another reason for providing color balance adjustment, in addition to correcting for manufacturing variations in the phosphor, is to correct for phosphor aging through prolonged display use. It is typical for the light emitting characteristics of the phosphor of a FED screen to change over time as it is used. Therefore, it is important that a display screen have a mechanism for altering its color balance to correct for phosphor aging to maintain image quality throughout the life of the FED screen. A further reason for providing color balance adjustment within a display screen is to allow the viewer to manually adjust the color balance. Using a manual adjustment, users can adjust the white balance of the display screen to their particular viewing taste.

One method for correcting or altering the color balance within a display screen is to alter, on the fly, the color data used to render a screen. Instead of sending a particular color point a color value of X, the color value of X is first passed through a function that has a gain and an offset. The output of the function, Y, is then sent to the color point. The function compensates for any variations in the color temperature caused by phosphor variations. The values of the above function can be altered as the color temperature needs to be increased or decreased. Although offering dynamic color balance adjustment, this prior art mechanism for altering the color balance is disadvantageous because it requires relatively complex circuitry for altering the large volume of color data. The additional circuitry this prior art mechanism requires may also add to the overall size of the driver circuits. Assuming a horizontal screen resolution of 1024 white pixels, there can be as many as 3072 column drivers per FED screen. Any increase in column driver size is therefore duplicated several thousand times. Secondly, this prior art mechanism may degrade the quality of the image by reducing the gray-scale resolution of the flat panel display. It is desirable to provide a color balance adjustment mechanism for a flat panel display screen that does not alter the image data nor compromise the gray-scale resolution of the image.

Another method of correcting for color balance within a flat panel display screen is used in active matrix flat panel display screens (AMLCD). This method pertains to altering the physical color filters used to generate the red, green and blue color points. By altering the color the filters, the color temperature of the AMLCD screen can be adjusted. However, this adjustment is not dynamic because the color filters need to be physically (e.g., manually) replaced each time adjustment is required. It would be advantageous to provide a color balancing mechanism for a flat panel display screen that can respond, dynamically, to required changes in the color temperature of the display.

FIG. 1 is a graph 6 of a typical data-in voltage-out curve that is embedded within a digital to analog converter circuit of an AMLCD flat panel display. The digital to analog converter is responsible for transforming the digital color data to voltages that are used to generate the actual color intensity. When presented with color data from 0 to 63, the voltages corresponding to curve portion 2 are supplied as output to drive the color points. When presented with color data from 64 to 127, the voltages corresponding to curve portion 4 are supplied as output to drive the color points. Curve portion 4 may be the same as curve portion 2 except with a DC voltage offset. Curve portion 4 and curve portion 2 are used in alternating refresh cycles so that no net DC voltage is applied to the cells of the AMLCD display. Prolonged exposure to DC voltage can destroy the AMLCD display. Therefore, the gray scale resolution of the AMLCD device using curves 2 and 4 is only from 0 to 63, although 127 data positions exist. This is the case because positions 64 to 127 are only duplicates, respectively, of positions 0 to 63. Although used in the manner described above, the data-in voltage-out function of FIG. 1 has never been applied to perform any type of color balancing operations.

Accordingly, the present invention provides a mechanism and method for dynamically adjusting the color balance of a flat panel display. The present invention provides a mechanism and method for adjusting the color balance of a flat panel display screen that does not compromise the gray-scale resolution of the pixels of the display screen. Further, the present invention provides a mechanism and method for adjusting the color balance of a flat panel display screen without increasing the size of the column driver circuits. The present invention also provides a mechanism for altering the color balance of a flat panel display screen that does not alter the image data supplied to the column driver circuits. Further, the present invention provides a mechanism and method for controlling the color balance of a flat panel FED screen. These and other advantages of the present invention not specifically mentioned above will become clear within discussions of the present invention presented herein.

SUMMARY OF THE INVENTION

A circuit and method are described herein for controlling the color balance of a flat panel display without losing gray scale capability of the display screen. In one embodiment, a field emission display (FED) screen is used. Within the FED screen, a matrix of rows and columns is provided and emitters are situated within each row-column intersection. Rows are activated sequentially by row drivers and corresponding individual gray scale information (voltages) is driven over the columns by column drivers. When the proper voltage is applied across the cathode and anode of the emitters, they release electrons toward a phosphor spot, e.g., red, green, blue, causing an illumination point.

The present invention includes, within each column driver, a digital to analog converter that contains two data-in voltage-out transformation functions, a first function corresponding to a first voltage intensity and a second function corresponding to a lesser voltage intensity for a same input digital color data. The digital color data for a column line is input to two analog switches that each generate a separate voltage output value. During the row on-time window, the present invention time multiplexes application of the voltages corresponding to the first and second functions for driving color information (e.g., voltages) over the column line. In one embodiment, the first function corresponds to a predetermined intensity value and the second function corresponds to half of this predefined intensity, but any relative portion can be used.

There is a separate timing signal for each color (e.g., red, green, blue) that defines the multiplexing intervals during which the two voltages are separately applied. By adjusting the length of the timing signal for a particular color, the intensity of all illumination spots of that color can be adjusted up or down relative to the other colors. This provides an effective color balancing technique that does not require expansion of the color driver substrate area nor does it degrade the gray scale capability of the FED screen. Adjustment of color balancing can be done in response to tube aging, viewer taste and/or manufacturing variations in the phosphor.

Specifically, embodiments of the present invention include a field emission display device comprising: a resistor chain for providing voltage taps; a plurality of column drivers each coupled to a respective column and for driving voltage signals over the respective column line; a plurality of row drivers each coupled to a respective row line, the plurality of row drivers for driving a row voltage signal over one row line at a time, wherein a pixel is comprised of intersections of one row line and at least three column lines; and a horizontal synchronization clock signal for synchronizing the refresh of individual row lines by initiating a row on-time pulse window, and wherein each of the column drivers comprises: an digital to analog converter coupled to the resistor chain and for receiving color data and supplying a first voltage signal representative of the color data and for supplying a second voltage signal representative of the color data; and a selector circuit coupled to receive the first and second voltage signals and coupled to receive an adjustable timing signal, the selector circuit for performing color balancing by time multiplexing the first and second voltage signals on the respective column line within the row on-time pulse window, wherein the first voltage is applied in coincidence with the adjustable timing signal and the second voltage signal is applied thereafter.

Embodiments include the above and wherein the digital to analog converter contains a first data-in voltage-out function stored therein that corresponds to color intensity of a first level and wherein the digital to analog converter further contains a second data-in voltage-out function stored therein that corresponds to color intensity of a second level, the second level being less than the first level.

DETAILED DESCRIPTION OF THE INVENTION

In the following detailed description of the present invention, a method and mechanism for dynamically altering the color balance within a flat panel FED screen without compromising gray-scale resolution, numerous specific details are set forth in order to provide a thorough understanding of the present invention. However, it will be recognized by one skilled in the art that the present invention may be practiced without these specific details or with equivalents thereof. In other instances, well known methods, procedures, components, and circuits have not been described in detail as not to unnecessarily obscure aspects of the present invention.

FLAT PANEL FED SCREEN ORGANIZATION

Figure 1:
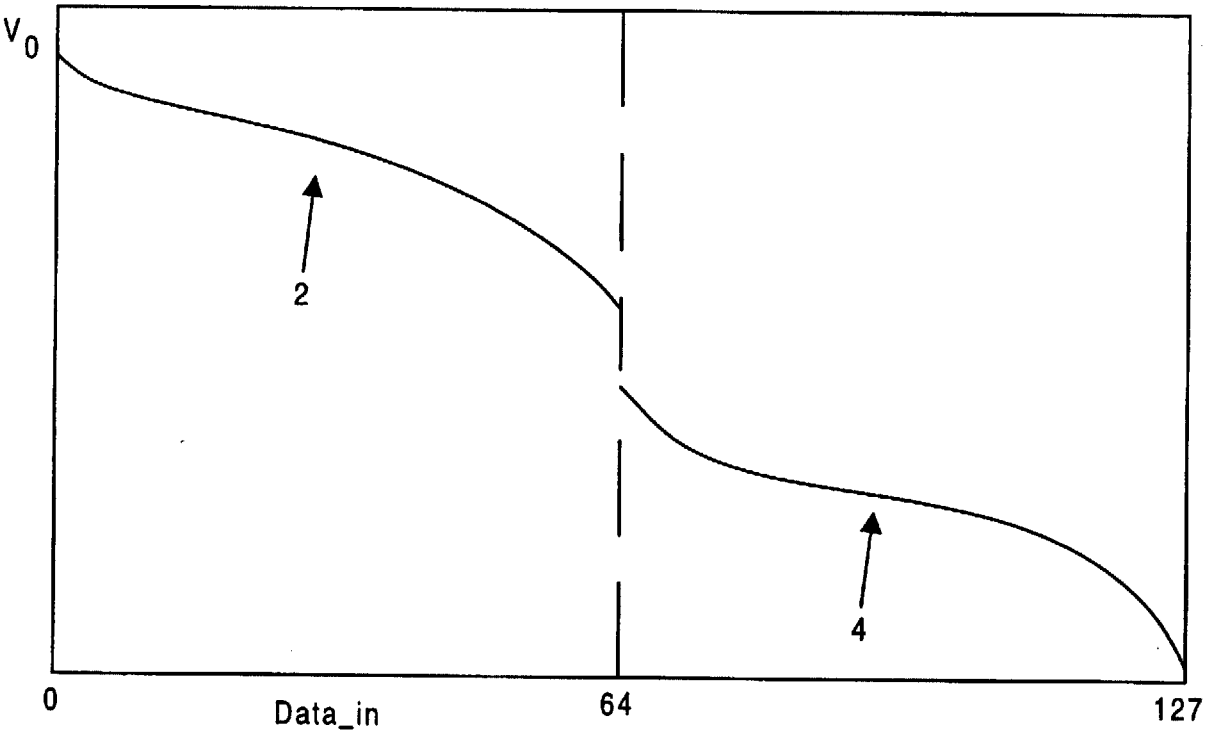
FIG. 1 Prior Art
FIG. 1 illustrates a data-in voltage-out function used by an active matrix liquid crystal display (AMLCD) of the prior art.
Figure 2:
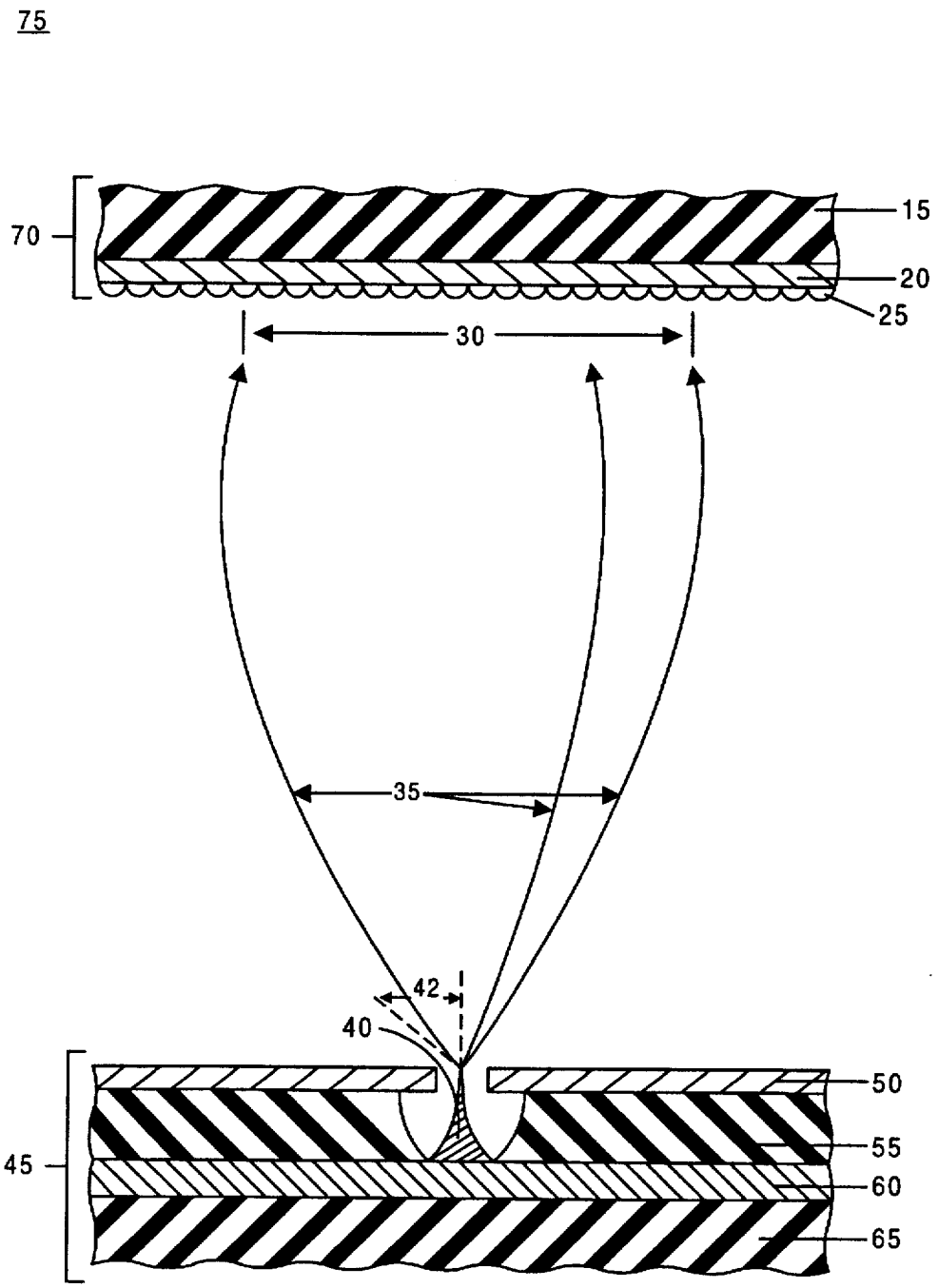
FIG. 2 is a cross-section structural view of part of a flat panel FED screen that utilizes a gated field emitter situated at the intersection of a row and a column line.

A discussion of an emitter of a field emission display (FED) is presented. FIG. 2 illustrates a cross-section diagram of a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No. 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display 75. Faceplate structure 70 is formed with an electrically insulating faceplate 15, an anode 20, and a coating of phosphors 25. Electrons emitted from element 40 are received by phosphors portion 30.

Anode 20 of FIG. 2 is maintained at a positive voltage relative to cathode 60/40. The anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 2 and impact on a target portion 30 of the phosphors 25. The phosphors struck by the emitted electrons produce light of a selected color and represent a phosphor spot or point. A single phosphor spot can be illuminated by thousands of emitters.

Phosphors 25 are part of a picture element ("pixel") that contains other phosphors (not shown) which emit light of different color than that produced by phosphors 25. Typically a pixel contains three phosphor spots, a red spot, a green spot and a blue spot. Also, the pixel containing phosphors 25 adjoins one or more other pixels (not shown) in the FED flat panel display. If some of the electrons intended for phosphors 25 consistently strike other phosphors (in the same or another pixels), the image resolution and color purity can become degraded. As discussed in more detail below, the pixels of an FED flat panel screen are arranged in a matrix form including columns and rows. In one implementation, a pixel is composed of three phosphor spots aligned in the same row, but having three separate columns. Therefore, a single pixel is uniquely identified by one row and three separate columns (a red column, a green column and a blue column). As described more fully below, each column of the three columns that constitute a pixel is associated with its own column driver circuit.

The size of target phosphor portion 30 depends on the applied voltages and geometric and dimensional characteristics of the FED flat panel display 75. Increasing the anode/phosphor voltage to 1,500 to 10,000 volts in the FED flat panel display 75 of FIG. 2 requires that the spacing between the backplate structure 45 and the faceplate structure 70 be much greater than 100–200 um. Increasing the interstructure spacing to the value needed for a phosphor potential of 1,500 to 10,000 causes a larger phosphor portion 30, unless electron focusing elements (e.g., gated field emission structures) are added to the FED flat panel display of FIG. 2. Such focusing elements can be included within FED flat panel display structure 75 and are described in U.S. Pat. No. 5,528,103 issued on Jun. 18, 1996 to Spindt, et al., which is incorporated herein by reference.

Importantly, the intensity of the target phosphor portion 30 depends on the magnitude of the incident current which is itself dependent upon the voltage potential applied across the cathode 60/40 and the gate 50. Thus, the intensity of a color spot is related to the voltage differential applied between the row and column at whose intersection the color spot is located. The larger the voltage potential, the larger the intensity of the target phosphor portion 30. Secondly, the intensity of the target phosphor portion 30 depends on the amount of time a voltage is applied across the cathode 40/60 and the gate 50 (e.g., on-time window). The larger the on-time window, the larger the intensity of the target phosphor portion 30. Therefore, within the present invention, the intensity of FED flat panel structure 75 is dependent on the voltage and the amount of time (e.g., "on-time") the voltage is applied across cathode 60/40 and the gate 50.

Figure 4:
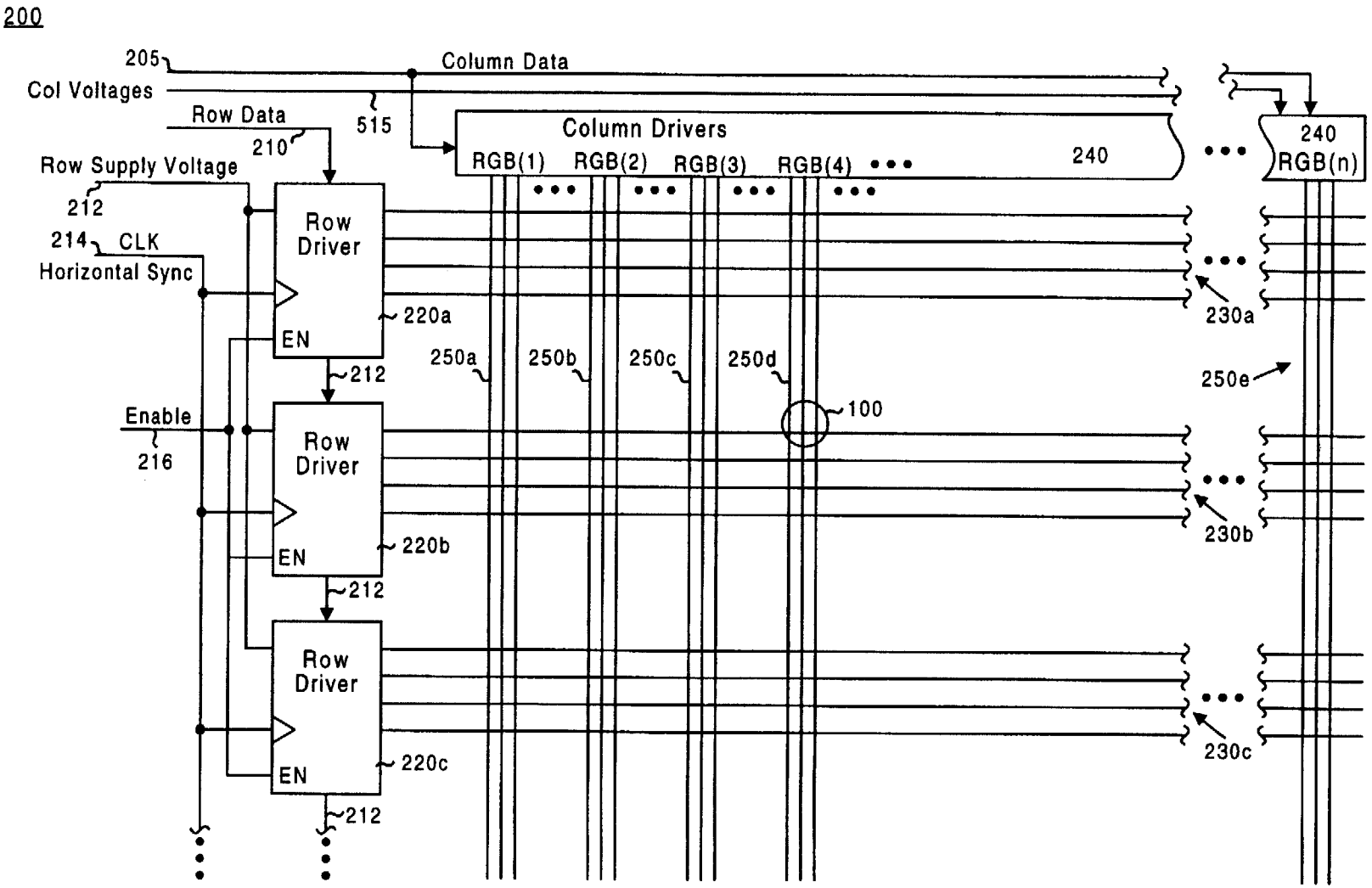
FIG. 4 illustrates a plan view of an flat panel FED screen in accordance with the present invention illustrating row and column drivers and numerous intersecting rows and columns.

As shown in FIG. 4, the FED flat panel display 200 is subdivided into an array of horizontally aligned row lines 230 and vertically aligned column lines 250. The pixels of the FED flat panel display 200 are also aligned vertically and horizontally.

Figure 3:
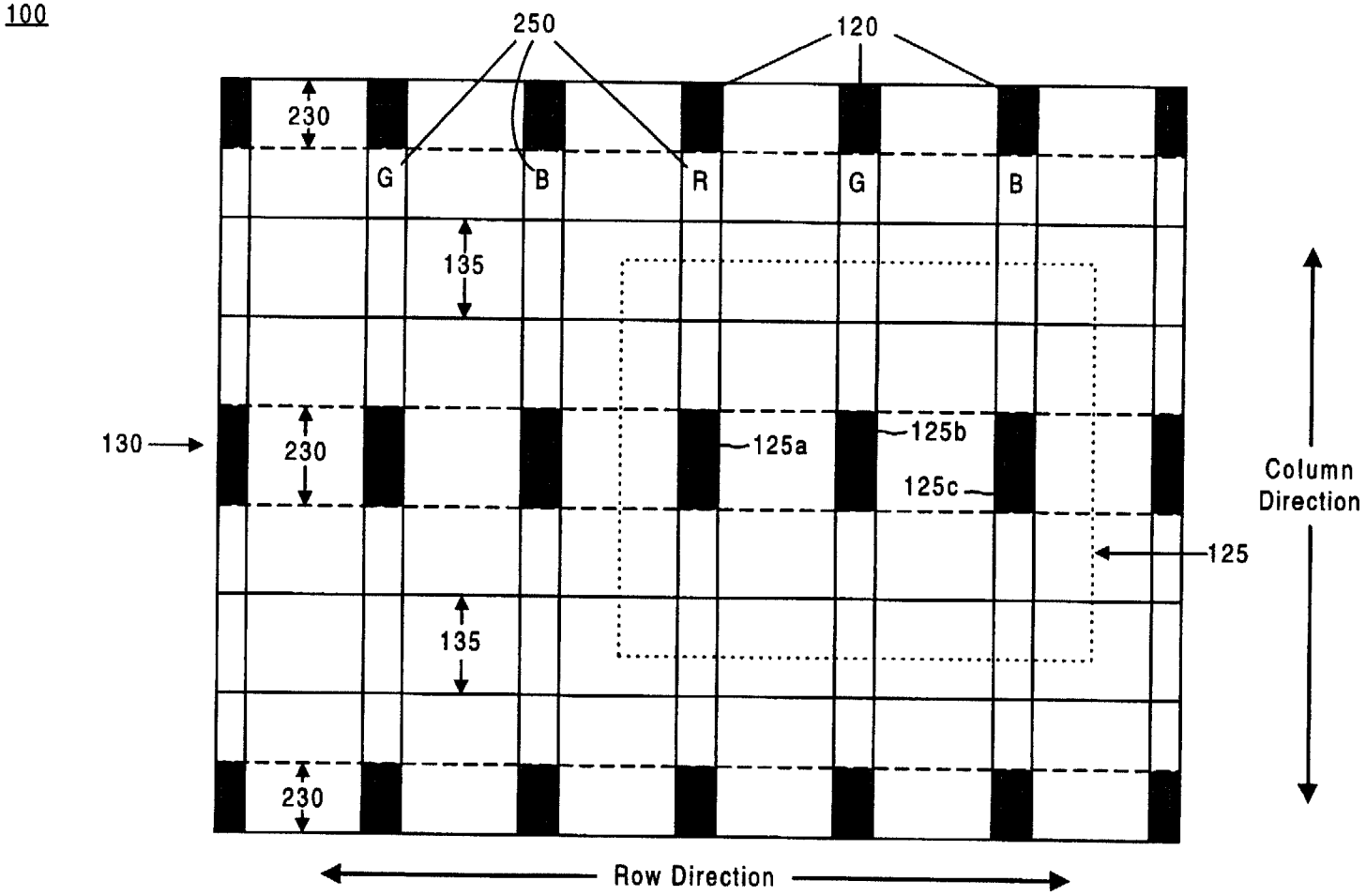
FIG. 3 is a plan view of internal portions of the flat panel FED screen of the present invention and illustrates several intersecting rows and columns of the display.

A portion 100 of this array is shown in more detail in FIG. 3. A respective pixel 125 (also called "white group") of FIG. 3 contains a red phosphor spot **125*a*, a green phosphor spot 125*b* and a blue phosphor spot 125*c***. In one embodiment, each phosphor spot of a pixel is controlled by a different column driver, but all phosphor spots of a pixel are controlled by the same row driver.

The boundaries of the respective pixel 125 of FIG. 3 are indicated by dashed lines. Three separate emitter lines 230 (row lines) are also shown. Each emitter line 230 is a row electrode for one of the rows of pixels in the array. The middle row electrode 230 is coupled to the emitter cathodes 60/40 (FIG. 2) of each emitter of the particular row associated with the electrode. A portion of one pixel row is indicated in FIG. 3 and is situated between a pair of adjacent spacer walls 135. A pixel row is comprised of all of the pixels along one row line 250. Two or more pixels rows (and as much as 24–100 pixel rows), are generally located between each pair of adjacent spacer walls 135. Each column of pixels has three gate lines 250: (1) one for red; (2) a second for green; and (3) a third for blue. Likewise, each pixel column includes one of each phosphor stripes (red, green, blue), three stripes total. Each of the gate lines 250 is coupled to the gate 50 (FIG. 2) of each emitter structure of the associated column. This structure 100 is described in more detail in U.S. Pat. No. 5,477,105 issued on Dec. 19, 1995 to Curtin, et al., which is incorporated herein by reference.

The red, green and blue phosphor stripes 25 (FIG. 2) are maintained at a positive voltage of 1,500 to 10,000 volts relative to the voltage of the emitter-electrode 60/40. When one of the sets of electron-emission elements 40 is suitably excited by adjusting the voltage of the corresponding row (cathode) lines 230 and column (gate) lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. Frames are presented at 60 Hz. Assuming n rows of the display array, each row is energized at a rate of 16.7/n ms. The above FED 100 is described in more detail in the following United States Patents: U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

FIG. 4 illustrates an FED flat panel display screen 200 organized in accordance with the present invention. The screen contains x rows and n columns of "pixels". Region 100, as described with respect to FIG. 3, is also shown in its relative position in FIG. 4. The FED flat panel display screen 200 consists of x number of row lines (horizontal) and 3xn number of column lines (vertical) to achieve n pixels (three column lines per pixel are required). For clarity, a row line is called a "row" and a column line is called a "column." Row lines are driven by x row driver circuits 220*a*–220*c*. Shown in FIG. 4 are exemplary row groups 230*a*, 230*b* and 230*c*. Each row group is associated with a particular row driver circuit; three row driver circuits are shown 220*a*–220*c*. In one embodiment of the present invention there are over 400 rows (x=400. However, it is appreciated that the present invention is equally well suited to an FED flat panel display screen having any number of rows. Also shown in FIG. 4 are column groups 250*a*, 250*b*, 250*c* and 250*d*. In one embodiment of the present invention there are over 1920 columns to allow n=640 pixels (1920/3). A pixel requires three columns (red, green, blue), therefore, 1920 columns provides at least 640 pixel resolution horizontally. However, it is appreciated that the present invention is equally well suited to an FED flat panel display screen having any number of columns.

Row driver circuits 220*a*–220*c* are placed along the periphery of the FED flat panel display screen 200. In FIG. 4, only three row drivers are shown for clarity. Each row driver 220*a*–220*c* is responsible for driving a group of rows. For instance, row driver 220*a* drives rows 230*a*, row driver 220*b* drives rows 230*b* and row driver 220*c* drives rows 230*c*. Although an individual row driver is responsible for driving a group of rows, only one row is active at a time across the entire FED flat panel display screen 200. Therefore, an individual row driver drives at most one row line at a time, and when the active row line is not in its group during a refresh cycle it is not driving any row line. A supply voltage line 212 is coupled in parallel to all row drivers 220*a*–220*c* and supplies the row drivers with a driving voltage for application to the cathode 60/40 of the emitters. In one embodiment, the row driving voltage is negative in polarity.

An enable signal is also supplied to each row driver 220*a*–220*c* in parallel over enable line 216 of FIG. 4. When the enable line 216 is low, all row drivers 220*a*–220*c* of FED screen 200 are disabled and no row is energized. When the enable line 216 is high, the row drivers 220*a*–220*c* are enabled.

A horizontal clock signal 214 is also supplied to each row driver 220*a*–220*c* in parallel over clock line 214 of FIG. 4. The horizontal clock signal 214 (or synchronization signal) pulses upon each time a new row is to be energized. The x rows of a frame are energized, one at a time with the columns receiving the respective data. When all rows have been energized, a frame of data is displayed. Assuming an exemplary frame update rate of 60 Hz, all rows are updated once every 16.67 milliseconds. Assuming x rows per frame update, the horizontal clock signal pulses once every 16.67/x milliseconds. In other words a new row is energized every 16.67/n milliseconds. If x is 400, the horizontal clock signal pulses once every 41.67 microseconds.

All row drivers of FED 200 are configured to implement one large serial shift register having x bits of storage, one bit per row. Row data is shifted through these row drivers using a row data line 212 that is coupled to the row drivers 220*a*–220*c* in serial fashion. During sequential frame update mode, all but one of the bits of the n bits within the row drivers contain a "0" and the other one contains a "1". Therefore, the "1" is shifted serially through all n rows, one at a time, from the upper most row to the bottom most row. Upon a given horizontal clock signal pulse, the row corresponding to the "1" is then driven for the on-time window. The bits of the shift registers are shifted through the row drivers 220*a*–220*c* once every pulse of the horizontal clock as provided by line 214. In interlace mode, the odd rows are updated in series followed by the even rows. A different bit pattern and clocking scheme is therefore used.

The row corresponding to the shifted "1" becomes driven responsive to the horizontal clock pulse over line 214. The row remains on during a particular "on-time" window. During this on-time window, the corresponding row is driven with the voltage value as seen over voltage supply line 212 if the row drivers are enabled. During the on-time window, the other rows are not driven with any voltage. As discussed more fully below, the present invention time multiplexes certain voltages during the on-time window to alter the color balance of the FED flat panel display screen 200 of FIG. 4. To increase the color intensity, the column voltages are increased during the on-time window. To decrease the color intensity, the column voltages are decreased during on-time window. Since the color data of the column drivers are not altered during color balancing, the present invention does not degrade gray-scale resolution by altering color balancing in the above fashion. In one embodiment, the rows are energized with a negative voltage.

As shown by FIG. 3, there are three columns per pixel (or "white group") within the FED flat panel display screen 200 of the present invention. Column lines 250*a* of FIG. 4 control one column of pixels, column lines 250*b* control another column of pixels, etc. FIG. 4 also illustrates the column drivers 240 that control the gray-scale information for each pixel. The column drivers 240 drive amplitude modulated voltage signals over the column lines. In an analogous fashion to the row driver circuits, the column drivers 240 can be broken into separate circuits that each drive groups of column lines. The amplitude modulated voltage signals driven over the column lines 250*a*–250*e* represent gray-scale data for a respective row of pixels. Once every pulse of the horizontal clock signal at line 214, the column drivers 240 receive gray-scale digital color data to independently control all of the column lines 250*a*–250*e* of a pixel row of the FED flat panel display screen 200. Therefore, while only one row is energized per horizontal clock, all columns 250*a*–250*e* are energized during the on-time window. The horizontal clock signal over line 214 synchronizes the loading of a pixel row of gray-scale data into the column drivers 240. Column drivers 240 receive column data over column data line 205 and column drivers 240 are also coupled in common to a number of voltage tap lines which are included within column voltage supply line 515.

Different voltages are applied to the column lines by the column drivers 240 to realize different gray-scale colors. In operation, all column lines are driven with gray-scale data (over column data line 205) and simultaneously one row is activated. This causes a row of pixels of illuminate with the proper gray-scale data. This is then repeated for another row, etc., once per pulse of the horizontal clock signal of line 214, until the entire frame is filled. To increase speed, while one row is being energized, the gray-scale data for the next pixel row is simultaneously loaded into the column drivers 240. Like the row drivers, 220*a*–220*c* the column drivers assert their voltages within the on-time window. Further, like the row drivers 220*a*–220*c*, the column drivers 240 have an enable line. In one embodiment, the columns are energized with a positive voltage.

The following describes the mechanisms used by embodiments of the present invention for providing dynamic color balance adjustment within the framework of an FED screen 200 as described above.

COLOR BALANCE CONTROL CIRCUITRY OF THE PRESENT INVENTION

As described more fully below, the present invention provides a mechanism for uniformly increasing or decreasing the column voltages applied from the column drivers of a particular color in order to perform color balancing. More specifically, the present invention provides a mechanism for uniformly increasing or decreasing the voltage applied by all red (or green or blue) column drivers by a particular percentage to increase or decrease, respectively, the intensity of the red (or green or blue) spots uniformly over the FED screen 200.

Figure 5:
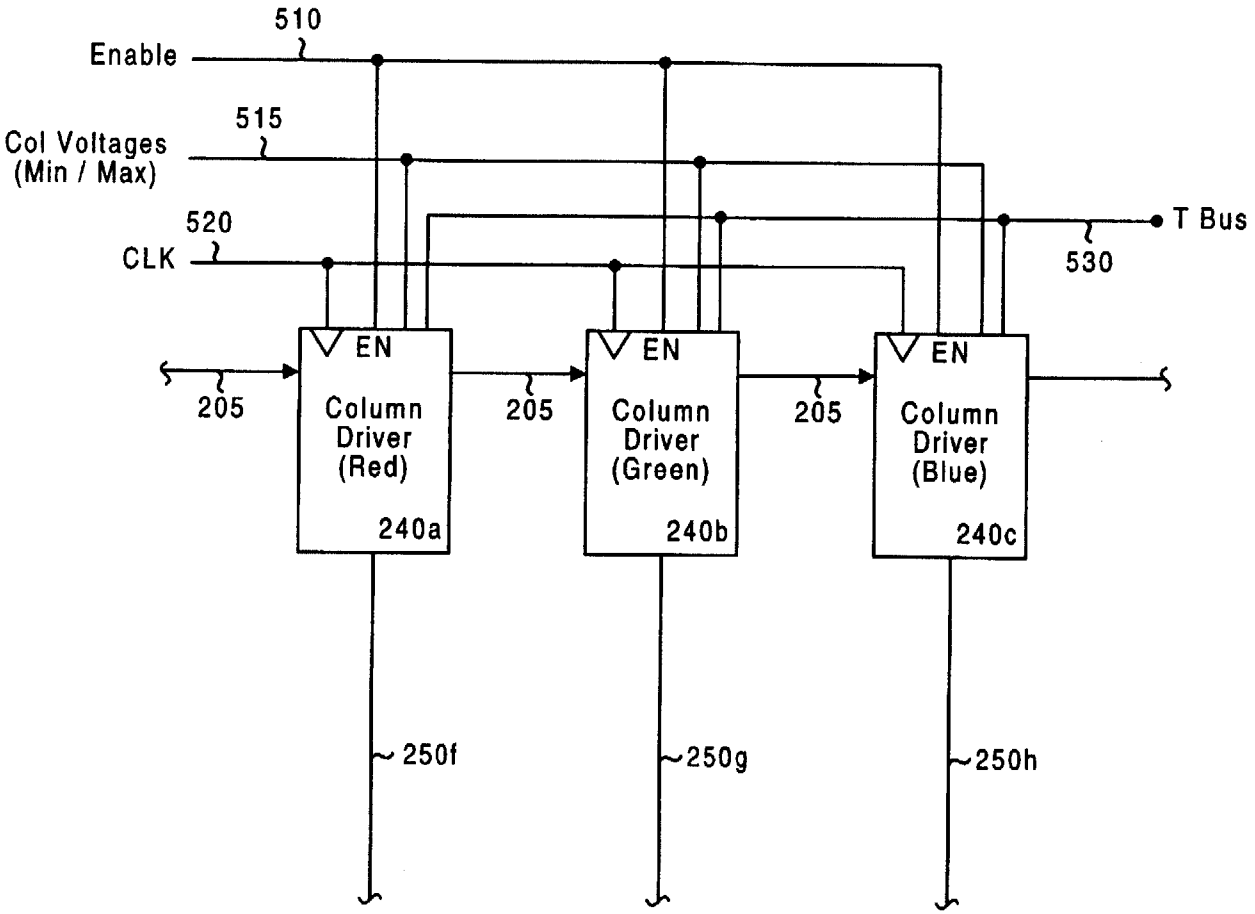
FIG. 5 is an illustration of three exemplary column drivers (red/green/blue) of the flat panel FED screen of the present invention.

FIG. 5 illustrates three separate and exemplary column drivers 240*a*–240*c* of FED flat panel display screen 200 that drive exemplary column lines 250*f*–250*h*, respectively. These three column lines 250*f*–250*h* correspond to the red, green and blue lines of a column of pixels (also called a column of white groups). Gray-scale information is supplied over data bus 250 as digital color data to the column drivers 240*a*–240*c*. The gray-scale information causes the column drivers to assert different voltage amplitudes to realize the different grayscale contents of the pixel. Different gray-scale data for a row of pixels are presented to the column drivers 240*a*–240*c* for each pulse of the horizontal clock signal. As discussed more fully below, the present invention provides a mechanism for adjusting the color balance of a pixel by controlling circuitry within each column driver, e.g., 240*a*, 240*b* and 250*c*.

In one embodiment, the digital color data is presented to each column driver in a six bit word and may include a seventh bit to differentiate between two different data-in voltage-out functions stored within a digital to analog converter of each column driver. Each column driver 240*a*–240*c* of FIG. 5 also has an enable input that is coupled to enable line 510 which is supplied in parallel to each column driver 240*a*–240*c*. Each column driver 240*a*–240*c* is coupled to a column voltage line 515 which includes voltage tap lines that originate from a resistor chain. These voltage tap lines are coupled to analog switches located within each column driver, e.g., 240*a*, 240*b* and 250*c*. The column drivers 240*a*–240*c* also receive a column clock signal 520 for clocking in the gray-scale data for a particular row of pixels. A timing bus 530 includes a red timing signal 345*a*, a green timing signal 345*b* and a blue timing signal 345*c* (FIG. 6) for embodiments of the present invention where the color timing signals 345*a*–345*c* are externally generated.

In accordance with the present invention, the color intensity of all color spots of the FED screen 200 of a particular color can be adjusted to perform color balancing. Adjustments to the color balance can be performed in response to FED screen aging or to manufacturing variations of the phosphors within the FED screen 200. Alternatively, adjustments to the color balance can be performed by the viewer based on individual viewing taste. The following describes the circuitry used by the present invention for altering the color intensity of each color spot of a particular color within the frame work of the FED screen 200.

CIRCUIT OVERVIEW

Figure 6:
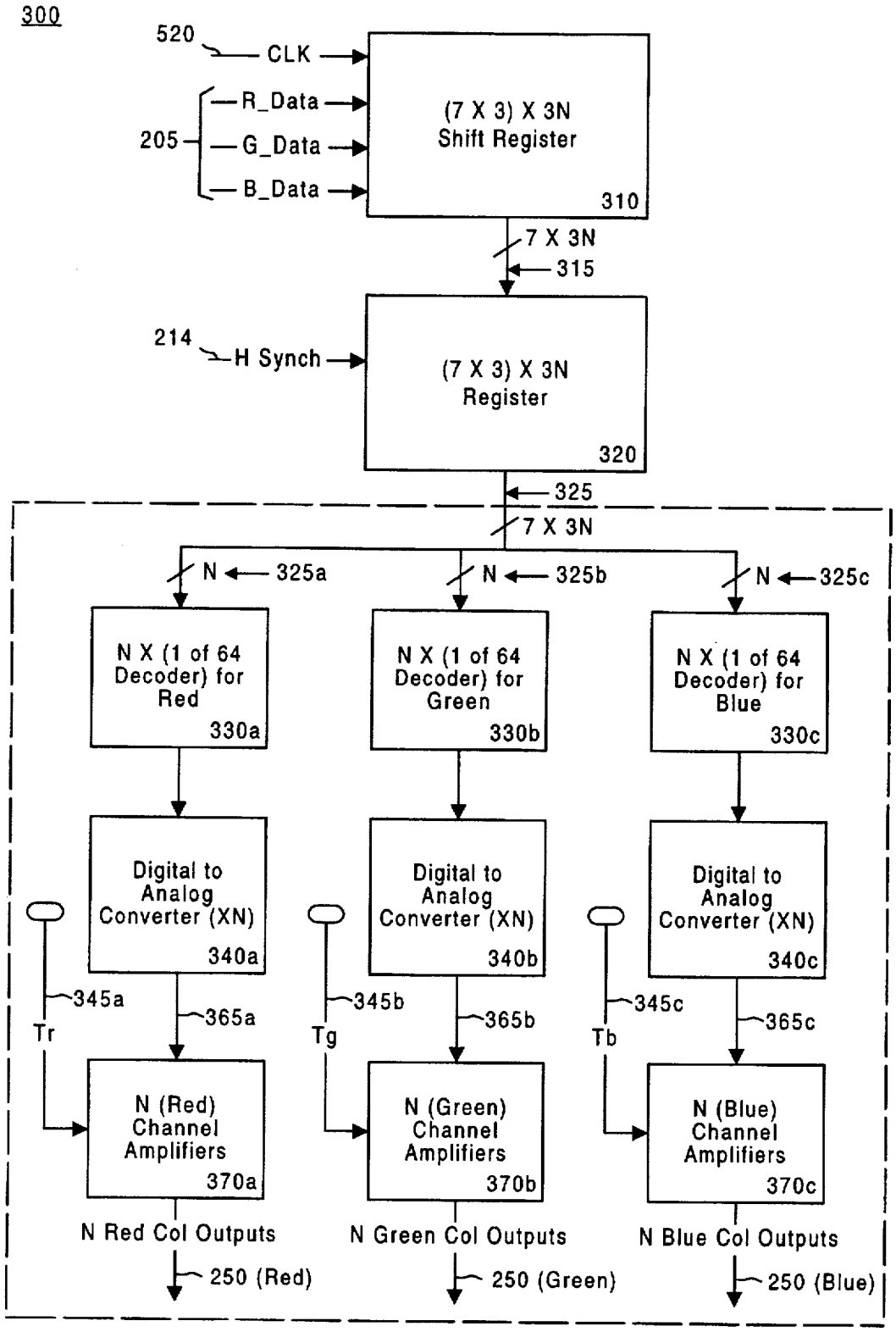
FIG. 6 is an overall block diagram of the distributed circuitry of the present invention used for adjusting color balance of the FED screen.

FIG. 6 illustrates a block diagram of a circuit 300 in accordance with the present invention for performing dynamic adjustments to the color balance of an FED screen 200 without compromising gray scale resolution. Within circuit 300, digital color data 205 representing a complete row of image data, including red data, green data and blue data, is clocked into multiple (e.g., 3n) shift registers 310 serially as shown on top. Clock signal 520 is the column clock signal and operates at a frequency sufficient to load all digital color data for a row of pixels within the period of successive horizontal clock signal pulses of line 214. The loading of a row of image data is synchronized to the horizontal clock signal 214.

Assuming FED screen 200 contains n pixels, there are 3n column drivers in the FED screen 200. More specifically, there are n number of blue column drivers and, for a given row of image data, each blue column driver receives an individual digital blue data. There are n number of red column drivers and, for a given row of image data, each red column driver receives an individual digital red data. Likewise, there are n number of green column drivers and, for a given row of image data, each green column driver receives an individual digital green data. Each color data, in one embodiment, is six bits wide and can include a seventh optional bit (or more). Therefore, shift register 310 of FIG. 6 actually represents 3n individual shift registers with each shift register (within each column driver) receiving seven bits of digital color data. Since a pixel requires one red, one green and one blue color, a pixel of color data requires 7×3 color bits.

The horizontal synchronization signal 214 latches in a row of image data into 3n holding registers as shown by block 320. Bus 325 represents all color data (7 bits×3n) for a given row of image data. Bus 325*a* represents all of the red color data of the row of image data and, in one embodiment, this comprises n number of 7 bit data. Bus 325*b* represents all of the green color data of the row of image data and, in one embodiment, this comprises n number of 7 bit data. Bus 325*c* represents all of the blue color data of the row of image data and, in one embodiment, this comprises n number of 7 bit data.

Blocks 330*a*–370*a* represent the circuitry required to perform color balancing for the n number of red column drivers and alter the red color to affect color balancing. Blocks 330*b*–370*b* represent the circuitry required to perform color balancing for the n number of green column drivers. Lastly, Blocks 330*c*–370*c* represent the circuitry required to perform color balancing for the n number of blue column drivers.

Block 330*a* of FIG. 6 represents n decoders, one for each red column driver. Each decoder receives a different red color data. In one embodiment, six of the 7 bits of color data are used by the decoders 330*a* to determine one of 64 different red color values for each red column driver.

Block 340*a* of FIG. 6 represents n digital to analog converters, one for each red column driver. In accordance with the present invention, each digital to analog converter of each red column driver contains two separate analog switch circuits that receive the same color data value. Each analog switch circuit maintains a different data-in voltage-out function (FIG. 7) and therefore each generates its own analog voltage output. The data-in voltage-out function determines a particular column voltage based on the input color data. The column voltage in turn translates to a particular color intensity for red.

In one embodiment, a first data-in voltage-out function corresponds to predetermined color intensity for each data-in value (wherein the maximum digital color value on the function corresponds to 100% color intensity achievable by the color spot) while the second data-in voltage-out function corresponds to half intensity (50%) of the first function. It is appreciated that the second function could also correspond equally well to any other ratio apart from 50% and that 50% is exemplary. Each digital to analog converter of block 340*a* also contains a selector circuit which receives both analog voltages from the two analog switch circuits and time multiplexes them over an output line that is connected to a channel amplifier circuit. There are n such time multiplexed output lines 365*a*, one for each of the n red column drivers of FED screen 200. A single red timing signal 345*a* is used for all red column drivers to control the intervals over which the analog voltages are time multiplexed over the individual red column lines 250(red).

Block 370*a* of FIG. 6 represents n channel amplifiers 370*a*, one for each of the n red column drivers. Each channel amplifier receives its corresponding time multiplexed output voltage signal from its corresponding selector circuit and asserts this signal over its corresponding red column line. In the aggregate, n column outputs 250(red) are generated. As discussed above, block 330*a*, block 340*a* and block 370*a* represent circuitry that is duplicated and therefore distributed within each red column driver of FED screen 200.

Circuit blocks 330*b*, 340*b* and 370*b* of FIG. 6 are analogous to blocks 330*a*, 340*a* and 370*a*, but cover the n circuits that apply to the n green column drivers and alter the green color to affect color balancing. A green timing signal 345*b* is used for all green column drivers to control the time multiplexing of the analog voltage signals over the individual green column lines 250(green). Therefore, block 330*b*, block 340*b* and block 370*b* represent circuitry that is duplicated and distributed within each green column driver of FED screen 200. Likewise, circuit blocks 330*c*, 340*c* and 370*c* are analogous to blocks 330*a*, 340*a* and 370*a*, but cover the n circuits that apply to the n blue column drivers and alter the blue color to affect color balancing. A blue timing signal 345*c* is used for all blue column drivers to control the time multiplexing of the analog voltage signals over the individual blue column lines 250(blue). Therefore, block 330*c*, block 340*c* and block 370*c* represent circuitry that is duplicated and distributed within each blue column driver of FED screen 200.

DIGITAL TO ANALOG CONVERTER HAVING TWO TRANSFORMATION FUNCTIONS

Figure 7:
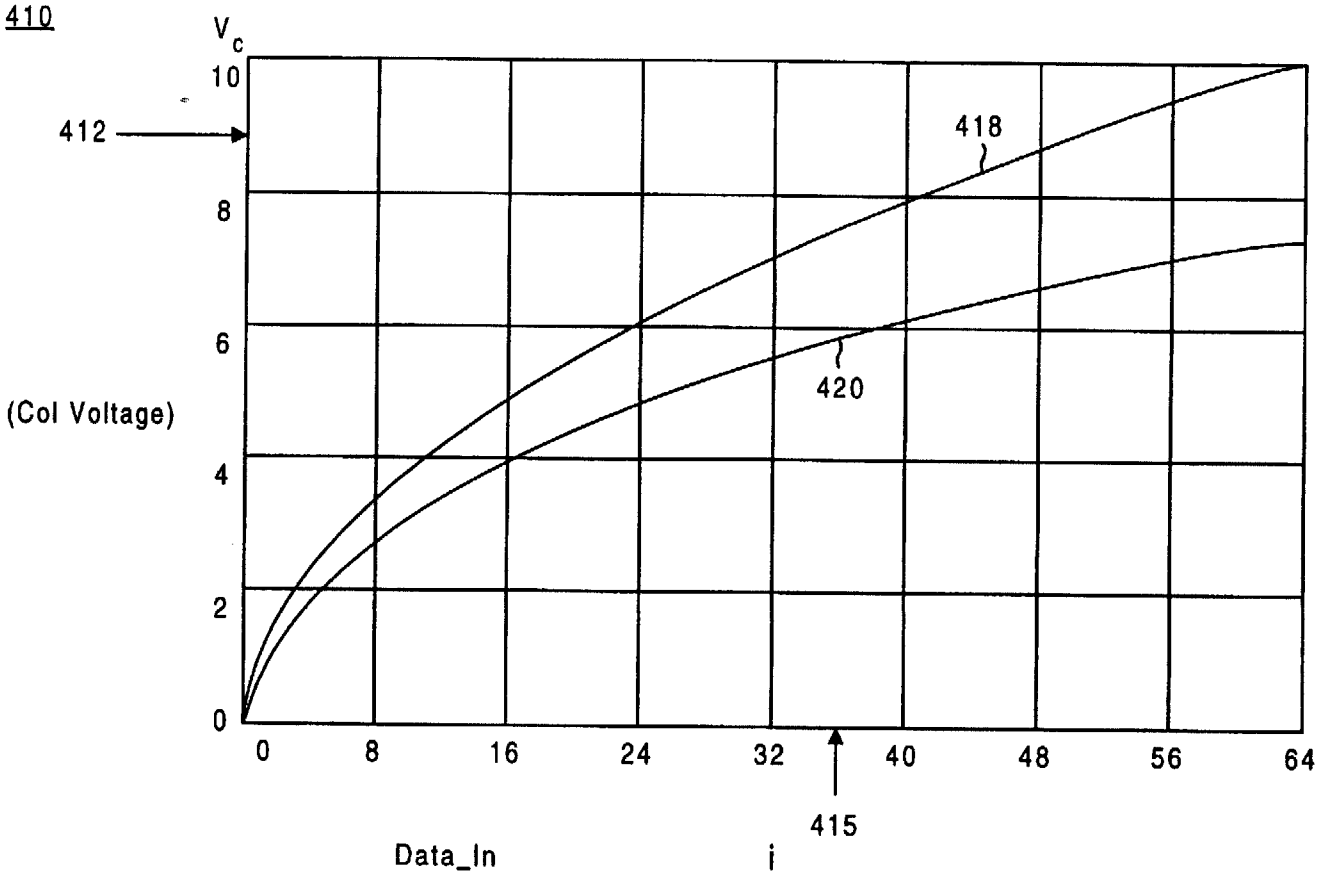
FIG. 7 illustrates the two data-in voltage-out curves used in accordance with one embodiment of the present invention.

FIG. 7 illustrates two exemplary data-in voltage-out functions 418 and 420 that are used by the digital to analog converter circuits in accordance with the present invention. The horizontal axis 415 represents the digital color data for a given color within the FED screen 200 of the present invention. This represents the input digital data to the digital to analog converter. In one embodiment, there are 64 different intensities to which each color can be driven. Any of a number of different resolution levels can be used within the scope of the present invention and 64 is but one exemplary value. Therefore, axis 415 includes 64 different color values. The vertical axis 412 represents the column voltage that is given as an output by the digital to analog converter corresponding to a particular digital color data value.

Data-in voltage-out function 418 represents one transfer function that has the property that at the maximum data value of 64 the column voltage output (e.g., 10 v) yields 100 percent color intensity achievable for the color spot. The function 418 is constructed such that incremental increases in color data correspond to the same proportion of incremental increases in color intensity being displayed at the color spot. For instance, with respect to function 418, color data value 32 corresponds roughly to a column voltage of 7.2 volts. This voltage output (7.2 v) yields one half of the color intensity as color data value 64 which corresponds to a column voltage of roughly 10 volts. Likewise, color data value 16 of function 418 corresponds roughly to a column voltage of 5.2 volts. This voltage output (5.2 v) yields one quarter of the color intensity as color data value 64 which corresponds to a column voltage of roughly 10 volts. As seen from FIG. 7, the transfer function 418 is not linear but is based on the physics behind the emitter device.

The digital to analog converter circuit of the present invention also contains a second transfer function 420 as shown in FIG. 7. Data-in voltage-out function 420 represents a transfer function that has the property that at the maximum data value of 64 the column voltage output (e.g., 7.2 v) yields 50 percent color intensity. Also, at every point along function 420, only 50 percent of the color intensity is generated compared to function 418. For instance, at data value 32, function 420 yields 50 percent of the color intensity as function 418. It is appreciated that 50 percent is an arbitrary value and that any value (e.g., from 10 percent to 90 percent) can be used for function 420. In accordance with the present invention, function 420 yields a lesser color intensity when compared to function 418 for a same digital color data value.

In operation, as described more fully below, the present invention time multiplexes, on a column line, the voltage signals that correspond to function 418 and function 420 for a given data color value. The amount of time over which the voltages are output is adjustable depending on the amount of color balance adjustment required for each particular color. In this manner, a dynamic color balance adjustment mechanism is provided by the present invention that does not compromise gray scale resolution.

For instance, assume a particular column driver (e.g., a blue column driver corresponding to the ith horizontal pixel) is to output a blue intensity corresponding to a digital color value of 16. The digital to analog converter of the present invention outputs two separate voltage values for an input of 16, one corresponding to the function 418 (5 v) and another corresponding to the second function 420 (3.8 v). Within the row on-time pulse window, the two voltages are time multiplexed. For instance, 5 volts are applied to the column line for a first time period followed by 3.8 volts for a second time period. The length of the first and second time periods is determined by a timing signal corresponding to all blue spots within the FED screen 200. In one embodiment, the first time period corresponds to the length of the higher intensity blue timing period and the first and second timing periods added together equal the time of the row on-time pulse. A discussion related to the above timing example is presented below with respect to FIG. 10 which contains timing diagrams in accordance with the present invention.

EXEMPLARY COLUMN DRIVER CIRCUITRY

Figure 8A:
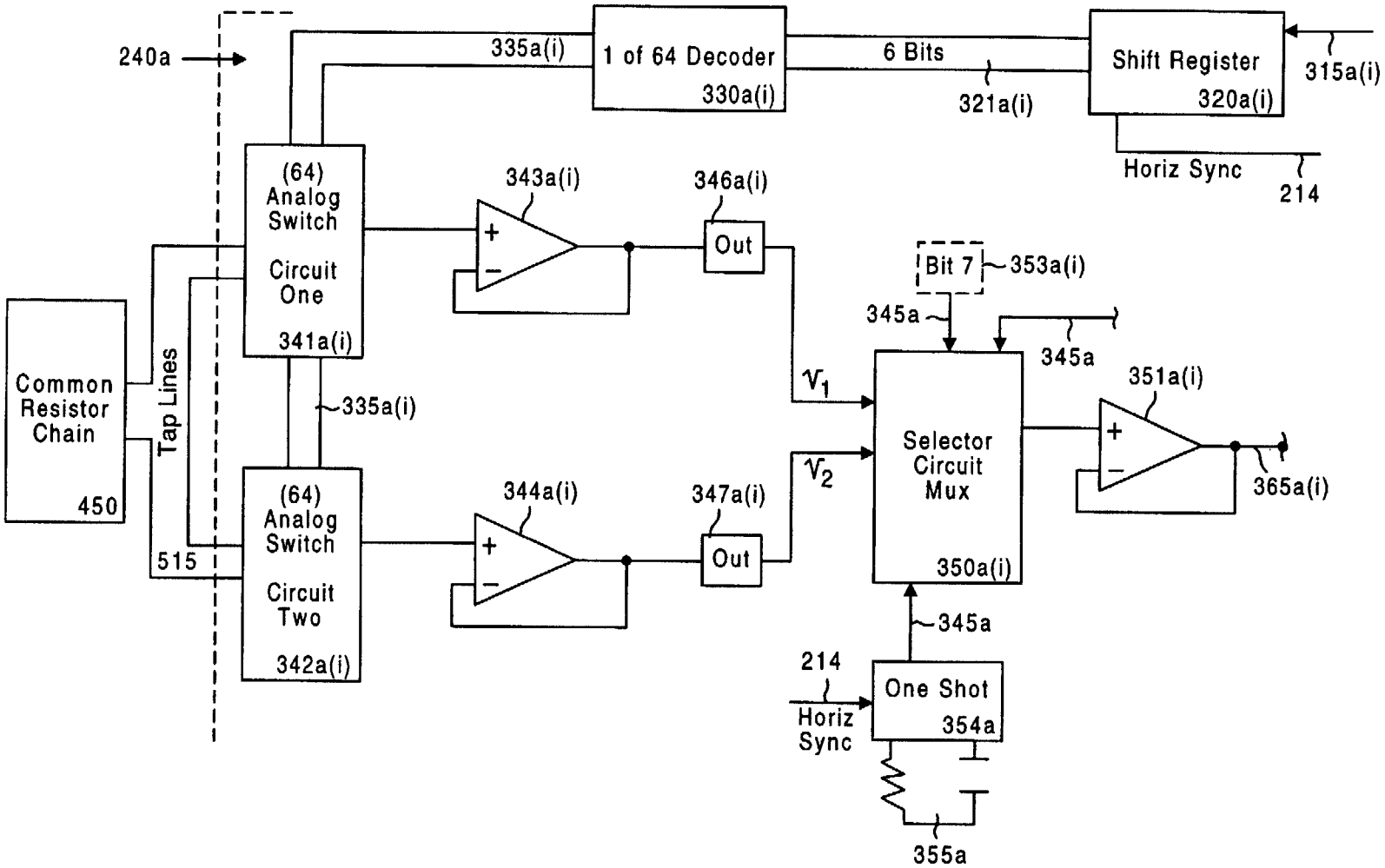
FIG. 8A is a circuit diagram of color balance adjustment circuitry used by the present invention in an exemplary red column driver for driving a red column line.
Figure 8B:
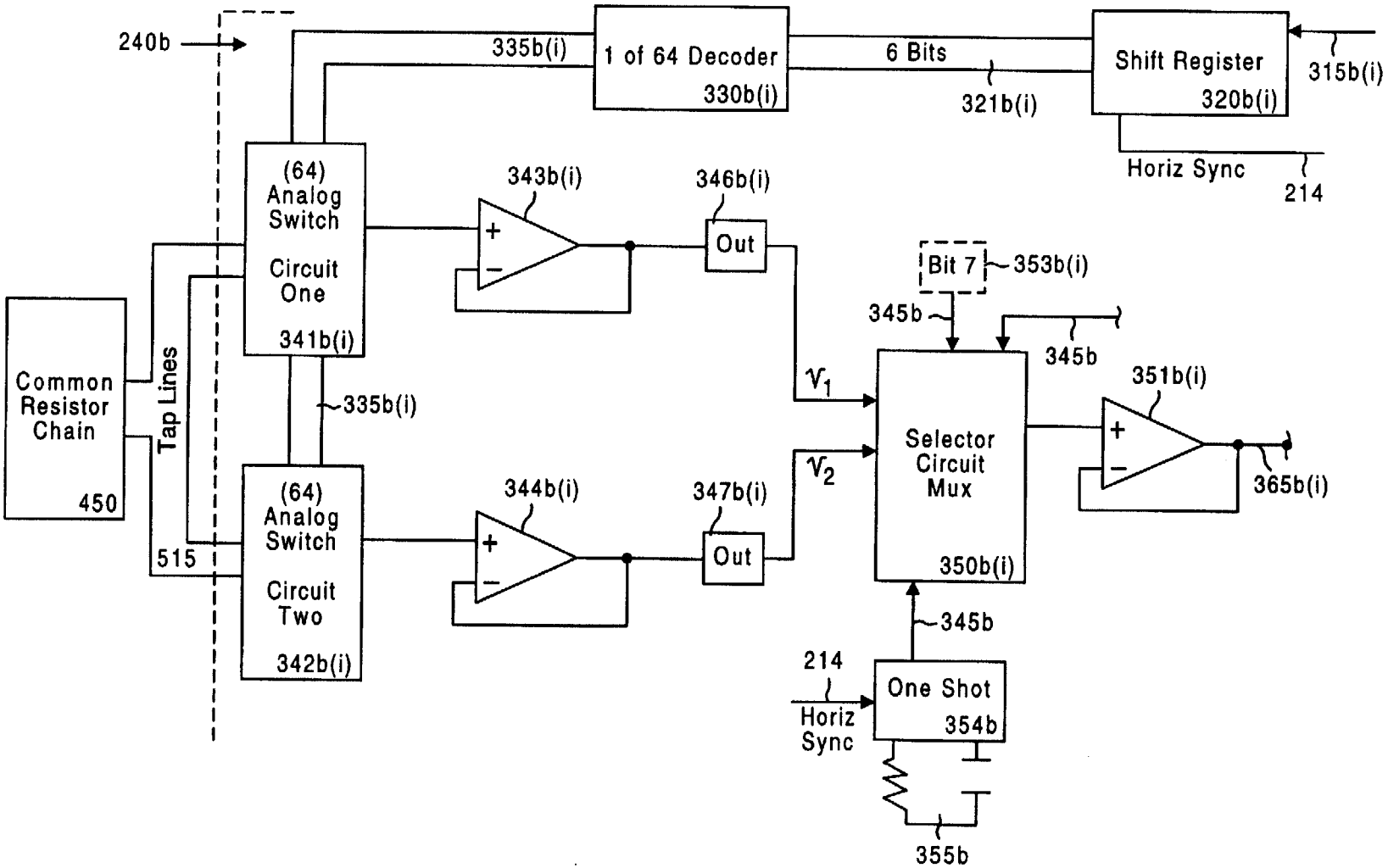
FIG. 8B is a circuit diagram of color balance adjustment circuitry used by the present invention in an exemplary green column driver for driving a green column line.
Figure 8C:
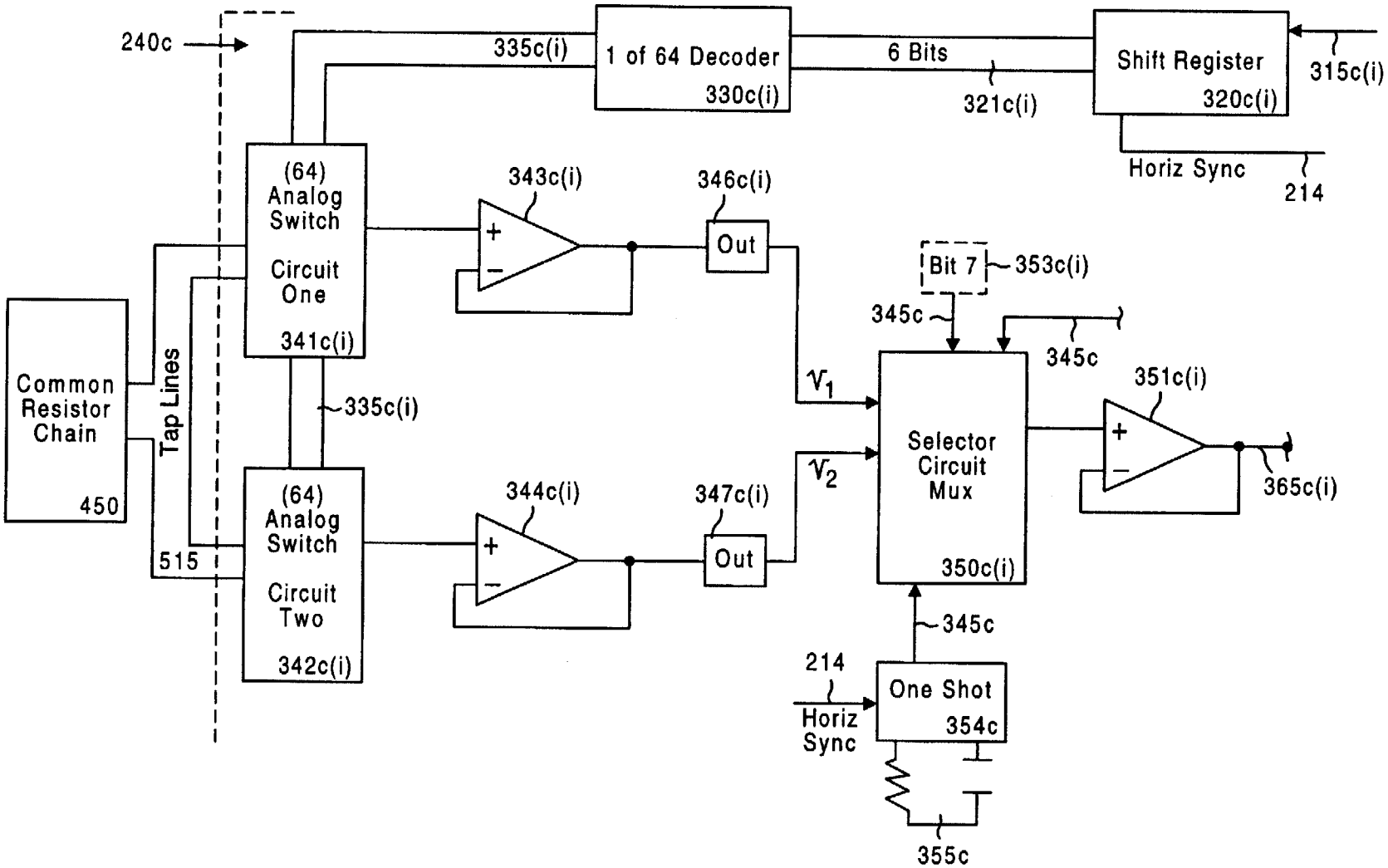
FIG. 8C is a circuit diagram of color balance adjustment circuitry used by the present invention in an exemplary blue column driver for driving blue column line.

FIG. 8A, FIG. 8B and FIG. 8C illustrate the circuitry used by the present invention for adjusting color balance within an FED screen 200 for three exemplary column drivers, the ith red column driver of the n red column drivers, the ith green column driver of the n green column drivers and the ith blue column driver of the n blue column drivers. These three exemplary ith column drivers represent the ith pixel along a given row of pixels. Components with FIGS. 8A, 8B and 8C that have the "(i)" designation are replicated for each column driver of the same color as the exemplary column driver to which they are described. Components without the "(i)" designation are not replicated within each column driver but rather are shared by all column drivers, or all column drivers of a similar color, as described more particularly below.

FIG. 8A illustrates circuitry with an exemplary red column driver 240*a* rib that drives the ith red column (250*f* of FIG. 9) within the ith pixel (of the n horizontal pixels) of the FED screen 200. On each pulse of horizontal synchronization signal 214, bus 315*a*(i) receives one seven bit color data value for the red intensity for the ith pixel of the current row. Six of these data bits are forwarded over bus 321*a*(i) in parallel to a 1 to 64 decoder circuit 330*a*(i) which generates a signal over a single output line of 64 bit bus 335*a*(i). The 64 bit bus 335*a*(i) is coupled to a first analog switch circuit 341*a*(i) and to a second analog switch circuit 342*a*(i). The decoder 330*a*(i), the analog switch circuits 341*a*(i) and 342*a*(i) in conjunction with the resistor chain 450 constitute a digital to analog converter.

Each of the analog switch circuits 341*a*(i) and 342*a*(i) of FIG. 8A are coupled to 64 tap lines 515 which originate from a resistor chain 450. The resistor chain 450 and the tap lines 515, in one embodiment of the present invention, are common to all column drivers 250 of the FED screen 200. In an alternative embodiment, three resistor chains and three tap lines are provided, one set being provided for all red column drivers, a second set being provided for all green column drivers and the last set of the three being provided for the blue column drivers. The tap lines 515 provide 64 analog voltage signals and represent 64 steps of voltage resolution from a minimum voltage level to a maximum voltage level. In the embodiment shown in FIG. 7, the minimum voltage is 0 v and the maximum voltage is 10 v. However any other combination of voltages could equally well be used within the scope of the present invention.

Analog switch circuit of 341*a*(i) has stored therein the first data-in voltage-out function 418 and analog switch circuit of 342*a*(i) contains stored therein the second data-in voltage-out function 420. In the well known way of digital to analog converter circuitry, the functions are stored as collection of transistor switches that associate a particular input of the 64 digital inputs from bus 335*a*(i) to a particular tap line of lines 515. In operation, the switches act as follows for circuit 341*a*(i). When a digital input from bus 335*a*(i) is received, its corresponding voltage (according to the first function 418) is selected from one of the tap lines 515 and then driven out by the switch over the output line if the analog switch circuit 341*a*(i) to optional amplifier circuit 343*a*(i). Switch circuit 342*a*(i) operates in similar manner but is based on a different data-in voltage-out function and drives optional amplifier 344*a*(i). It is appreciated that in one implementation, amplifier circuits 343*a*(i) and 344*a*(i) are eliminated thereby directly connecting switch circuit 341*a*(i) to circuit 345*a*(i) and directly connecting switch circuit 342*a*(i) to circuit 347*a*(i).

It is appreciated that both analog switch circuits 341*a*(i) and 342*a*(i) receive the same digital color data value from bus 335*a*(i), are each coupled to the same tap lines 515 and each have the capability to generate a different analog voltage signal out. Any of a number of well known analog switch circuit designs can be used for circuits 341*a*(i) and 342*a*(i). However, it is appreciated that all column drivers of a particular color share the same tap lines 515 thereby reducing the required substrate size of the column drivers. By way of example, assuming the functions 418 and 420 of FIG. 7 are stored in circuits 341(*a*)(i) and 342(*a*)(i), respectively. Assume the six bit color data of bus 321*a*(i) is "100110" or 40 decimal. The 40th line of bus 335*a*(i) would become asserted by the decoder 330*a*(i). Analog circuit 341*a*(i) would generate a voltage signal out of 8 v according to function 418 (FIG. 7) and circuit 342(*a*)(i) would generate a voltage signal out of 6 v according to function 420.

The first voltage signal of amplifier 343*a*(i) of FIG. 8A is buffered by circuit 346*a*(i) and is used as a first input to a selector circuit 350*a*(i). The second voltage signal of amplifier 344*a*(i) is buffered by circuit 347*a*(i) and used as a second input to the selector circuit 350*a*(i). The selector circuit 350*a*(i) is a time multiplexing circuit that will act to drive amplifier 351*a*(i) first with one of its inputs then with the other input within the period of time corresponding to the row one-time pulse. The division of time allocated to the first voltage input and to the second voltage input is defined according to a red timing pulse 345*a*. Amplifier 351*a*(i) drives the time multiplexed voltage signal over line 356*a*(i) to the corresponding ith red column line 250*f* (FIG. 9) that is associated with the ith red column driver 240*a*.

As shown in FIG. 8A, the red timing signal 345*a* can originate from different places. In one embodiment, as shown by the 345*a* label of the upper right on selector circuit 350*a*(i), the red timing signal 345*a* originates from an external source or time base (e.g., from bus 530 of FIG. 5). In this embodiment, the red timing signal 345*a* can originate from a feedback circuit that detects the white balance of the FED screen 200 and automatically compensates for variations of this white balance through a feedback mechanism. In a second embodiment, the red timing signal 346*a* originates from a one-shot circuit 354*a* that has an adjustable time period based on an adjustable resistor network 355*a*. The one-shot circuit 354*a* is synchronized to the horizontal synchronization signal 214. In a third embodiment, the red timing signal 345*a* is based directly on the seventh bit 353*a*(i) of the color data which originates from bus 315*a*(i) and stored in a bit register 353*a*(i).

It is appreciated that in one embodiment, the resistor chain 450 and the tap lines 515 are common to all column drivers of all colors. In an alternative embodiment, a different resistor chain and a different set of tap lines can be used for each color. Also, the one-shot 354*a* and the feedback circuit (of the first embodiment) are all common circuits for all column drivers of a same color and do not need to be replicated n times for all n red column drivers. The remainder of the circuitry of FIG. 8A having the "(i)" designation is replicated for and distributed with each red column driver of the n red column drivers of FED screen 200.

FIG. 8B illustrates circuitry with an exemplary green column driver 240*b* that drives the ith green column line 250*g* (FIG. 9) for the ith pixel (of the n horizontal pixels) of the FED screen 200. The circuitry of FIG. 8B, although replicated for and pertinent to the green column driver, is analogous to the circuitry of FIG. 8A except a green color data value is received over bus 315*b*(i) for the ith pixel. The resistor chain 450 and the tap lines 515 are the same as in FIG. 8A and are shared circuitry. Although the analog switch circuits 341*b*(i) and 342*b*(i) are replicated for the green column driver 240*b*, they use the same functions 418 and 420 in this embodiment of the present invention. Although the same functions as in FIG. 8A, they are addressed by green color data of the ith pixel. In an alternative embodiment, separate functions can be programmed into each analog switch circuit that are used only for the green column drivers.

As shown in FIG. 8B, the green timing signal 345*b* can originate from different places. In one embodiment, as shown by the 345*b* label of the upper right on selector circuit 350*b*(i), the green timing signal 345*b* originates from an external source or time base (e.g., from bus 530 of FIG. 5). In this embodiment, the green timing signal 345*b* can originate from a feedback circuit that detects the white balance of the FED screen 200 and automatically compensates for variations of this white balance through a feedback mechanism. In a second embodiment, the green timing signal 345*b* originates from a one-shot circuit 354*b* that has an adjustable time period based on an adjustable resistor network 355*b*. The one-shot 354*b* is synchronized to the horizontal synchronization signal 214. In a third embodiment, the green timing signal 345*b* is based directly on the seventh bit 353*b*(i) of the color data which originates from bus 315*b*(i) and stored in a bit register 353*b*(i). The green timing signal 345*b* is used by all of the n green column drivers.

It is appreciated that the resistor chain 450 and the tap lines 515 are common to all column drivers of all colors. In an alternative embodiment, a different resistor chain and a different set of tap lines can be used for each color. Also, the one-shot 354*b* and the feedback circuit (of the first embodiment) are all common circuits for all column drivers of a same color. The remainder of the circuitry of FIG. 8B having the "(i)" designation is replicated for and distributed within each green column driver of the n green column drivers of FED screen 200.

FIG. 8C illustrates circuitry with an exemplary blue column driver 240*c* that drives the ith blue column line 250*h* (FIG. 9) for the ith pixel (of the n horizontal pixels) of the FED screen 200. The circuitry of FIG. 8C although replicated for the blue column driver is analogous to the circuitry of FIG. 8A except a blue color data value is received over bus 315*c*(i) for the ith pixel. The resistor chain 450 and the tap lines 515 are the same as in FIG. 8A and are shared circuitry. In one embodiment, although the analog switch circuits 341*c*(i) and 342*c*(i) are replicated for the blue column driver 240*c*, they use the same functions 418 and. Although the same functions as in FIG. 8A, they are addressed by blue color data of the ith pixel.

As shown in FIG. 8C, the blue timing signal 345*c* can originate from different places. In one embodiment, as shown by the 345*c* label of the upper right on selector circuit 350*c*(i), the blue timing signal 345*c* originates from an external source or time base (e.g., bus 530 of FIG. 5). In this embodiment, the blue timing signal 345*c* can originate from a feedback circuit that detects the white balance of the FED screen 200 and automatically compensates for variations of this white balance through a feedback mechanism. In a second embodiment, the blue timing signal 345*c* originates from a one-shot circuit 354*c* that has an adjustable time period based on an adjustable resistor network 355*b*. The one-shot circuit 354*c* is synchronized to the horizontal synchronization signal 214. In a third embodiment, the blue timing signal 345*c* is based directly on the seventh bit 353*c*(i) of the color data which originates from bus 315*c*(i) and stored in a bit register 353*c*(i). The blue timing signal 345*c* is used by all of the n blue column drivers.

It is appreciated that the resistor chain 450 and the tap lines 515 are common to all column drivers of all colors. In an alternative embodiment, a different resistor chain and a different set of tap lines can be used for each color. Also, the one-shot circuit 354*c* and the feedback circuit (of the first embodiment) are all common circuits for all column drivers of a same color. The remainder of the circuitry of FIG. 8C having the "(i)" designation is replicated for and distributed within each blue column drivers of the n blue column drivers of FED screen 200.

Figure 9:
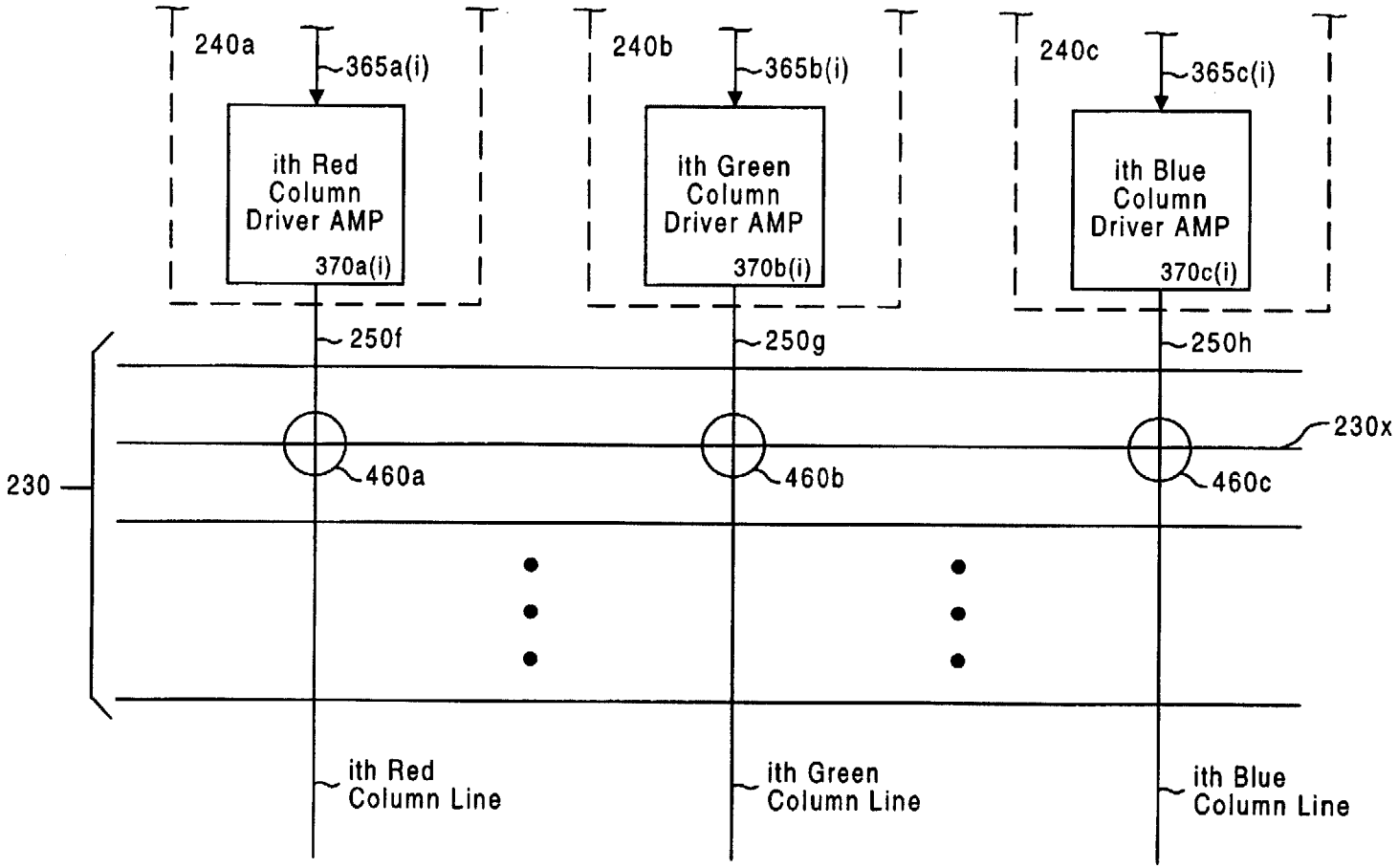
FIG. 9 illustrates the red, green and blue column driver amplifier circuits of an exemplary white pixel group in accordance with the present invention.

FIG. 9 illustrates the amplifier circuits 370*a*(i), 370*b*(i) and 370*c*(i) of the three exemplary column drivers 240*a*, 240*b* and 240*c* of the ith pixel. The amplifier circuits 370*a*(i), 370*b*(i) and 370*c*(i) are directly coupled to receive the outputs from the respective selector circuits and drive their respective column line with this voltage. Amplifier circuit 370*a*(i) receives output 365*a*(i) from the red selector circuit 350*a*(i); amplifier circuit 370*b*(i) receives output 365*b*(i) from the green selector circuit 350*a*(i); and amplifier circuit 370*c*(i) receives output 365*c*(i) from the blue selector circuit 350*c*(i). Column driver 240*a* drives a column voltage over ith red column line 250*f* to illuminate the ith red spot 460*a*. Column driver 240*b* drives a column voltage over ith green column line 250*g* to illuminate the ith green spot 460*b*. Column driver 240*c* drives a column voltage over ith blue column line 250*h* to illuminate the ith blue spot 460*c*. The red spot 460*a*, the green spot 460*b* and the blue spot 460*c* comprise the ith pixel for a given row, e.g., row line 230*x*.

It is appreciated that the circuitry designated with an "(i)" within column drivers 240*a*, 240*b* and 240*c*, including the column amplifier circuits 365*a*(i)–365*c*(i), is replicated for each of the n pixels of FED screen 200.

Figure 10:
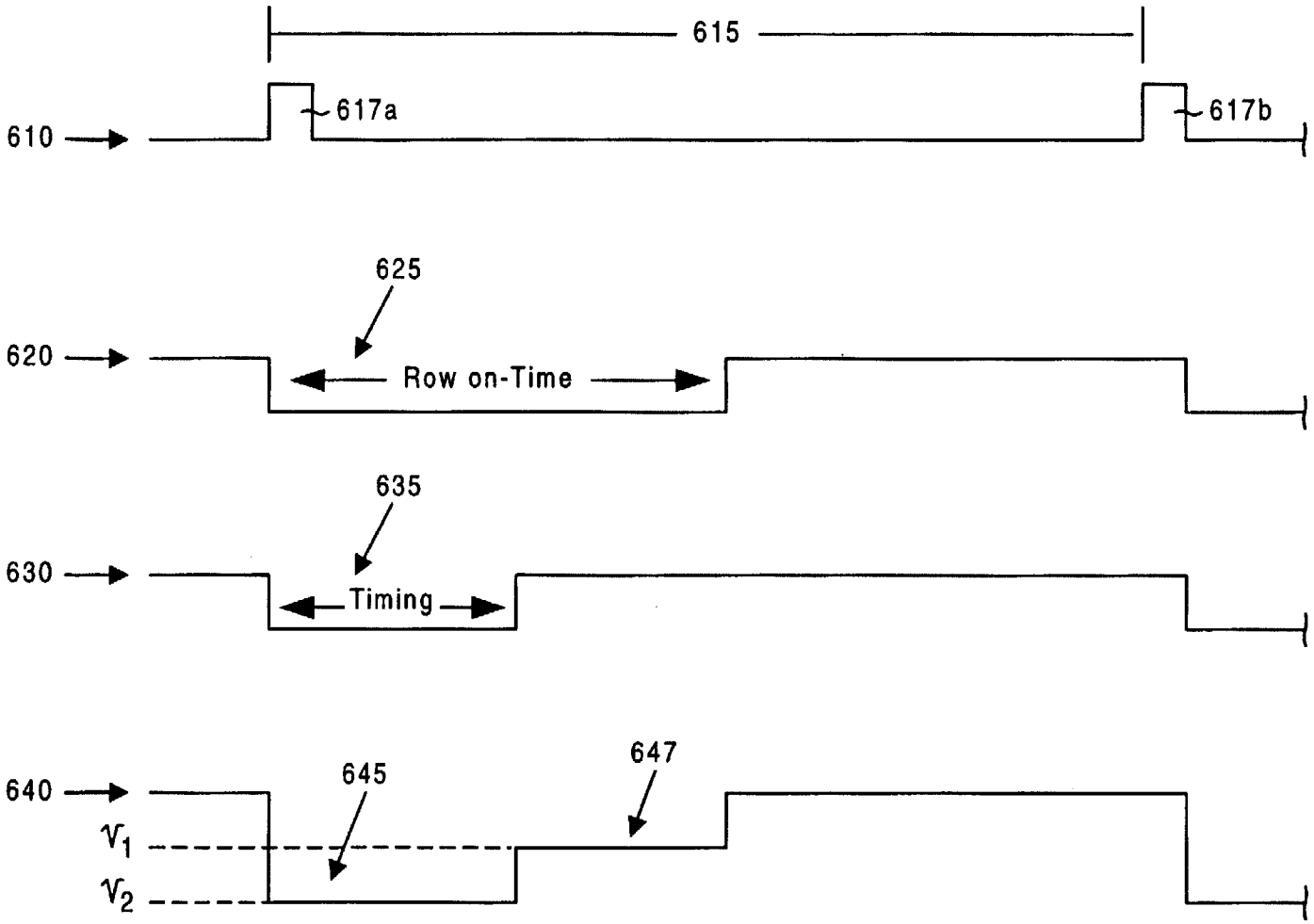
FIG. 10 illustrates a timing diagram of time multiplexed signals used in accordance with the present invention for color balance adjustment.

FIG. 10 illustrates a timing diagram of the time multiplexing capability of the selector circuit 350*a*(i). Signal 610 represents the horizontal synchronization clock 214. Pulse 617*a* starts the row-on time window 625 (of signal 620) during which a designated row receives an enabling voltage level while the other rows are disabled. Before the start of the row on-time window, the digital color data for all columns of this row has been loaded into each respective column driver. Signal 620, in one embodiment, corresponds to enable line 216 (FIG. 4). It is appreciated that the row on-time pulse can be as long as the time interval 615 between successive pulses (617*a*/617*b*) of the horizontal synchronization clock 214. Signal 630 corresponds to the red timing signal 345*a*. Red timing signal 345*a* is asserted during a time interval 635 within the row on-time pulse and is synchronized with the start of the horizontal synchronization clock 214. This interval 635 can be zero length in time or can be the full length of the row on-time pulse 625. Signal 640 illustrates the output voltage signal of amplifier 351*a*(i) and this voltage signal is driven over the ith red column line 250*f* (FIG. 9). Two voltages, V1 and V2, are input to the selector circuit 350*a*(i). These voltages are time multiplexed within the row on-time window 625 with voltage V2 applied first (within interval 645) and voltage V1 applied second (within interval 647). Interval 645 corresponds to the interval 635 of the red timing pulse.

The present invention is able to adjust for color balancing for a particular color by adjusting the length of the timing pulse that is supplied to all column drivers of a particular color. For instance, the color balance for red can be altered by increasing or decreasing the length of the red timing signal 345*a*. This will alter the amount of time the voltages V1 and V2 are applied to the respective red column lines which alters the aggregate voltage amount applied to these lines. Since the red timing pulse is applied to all red column drivers, they will uniformly adjust (up or down) the respective column voltages which are used to generate the red color intensities. Although each red column driver receives different color data, all color intensities will be uniformly increased or decreased by the same amount.

For instance, assume function 418 corresponds to a particular intensity level and function 420 corresponds to one half of this intensity value for all color data values as described with reference to FIG. 7. Assume also that a color balance adjustment is required that reduces the red intensity for all data values by 25%. In this case, instead of applying the voltage from function 418 across all of the row on-time window, the 100% value from function 418 is applied over half of the row on-time window and the 50% value from function 420 is applied over the other half of the row on-time window. This effectively reduces all red color intensities by 25% of the value corresponding to function 418. If more than 25% reduction is required then the length of time the output of function 418 is applied is reduced and the length of time the output from function 420 is applied is increased. If less than 25% reduction is required then the length of time the output of function 418 is applied is increased and the length of time the output from function 420 is applied is decreased. Similarly, this process can be applied to the blue color intensities by adjusting the blue timing signal 345*b* and to the blue color intensities by adjusting the blue timing signal 345*c*. Using this color balance adjustment mechanism, no loss in gray scale resolution is suffered.

In one implementation of the present invention, as illustrated in FIG. 4, several individual column drivers are associated together within a common substrate area and in this implementation architecture one multiple column driver drives multiple column lines independently of each other. In a particular implementation, for instance, there are 384 column drivers per multiple column driver. In this case, the resistor chain 450 and the tap lines 515 are duplicated for each multiple column driver. In this arrangement, the resistor chain 450 and tap lines 515 that are associated with a particular multiple column driver are shared by all the column drivers of the multiple column driver.

The preferred embodiment of the present invention, a method and mechanism to alter the color balance within an FED flat panel screen without compromising the gray-scale resolution of the display pixels, is thus described. While the present invention has been described in particular embodiments, it should be appreciated that the present invention should not be construed as limited by such embodiments, but rather construed according to the below claims.

What is claimed is:

1. A field emission display device comprising:

a resistor chain for providing voltage taps;

a plurality of column drivers each coupled to a respective column line, the column drivers for driving voltage signals over column lines;

a plurality of row drivers each coupled to a respective row line, the plurality of row drivers for driving a row voltage signal over one row line at a time, wherein a pixel is comprised of intersections of one row line and at least three column lines; and a horizontal synchronization clock signal for synchronizing the refresh of individual row lines by initiating a row on-time pulse window; and wherein each column driver comprises:

a first analog switch coupled to the resistor chain and for receiving color data and for supplying a first voltage signal representative of the color data;

a second analog switch coupled to the resistor chain and for receiving the color data and for supplying a second voltage signal representative of the color data; and a selector circuit coupled to receive the first and second voltage signals and for performing color balancing by generating a third voltage signal that time multiplexes the first and second voltage signals within the row on-time pulse, the third voltage signal applied to column line associated with the column driver.

2. A field emission display device as described in claim 1 wherein the first analog switch contains a first function stored therein that corresponds to color intensity of a first level.

3. A field emission display device as described in claim 2 wherein the second analog switch contains a second function stored therein that corresponds to color intensity of a second level, the second level being less than the first level.

4. A field emission display device as described in claim 3 wherein the first level is 100 percent intensity and wherein the second level is 50 percent intensity.

5. A field emission display device as described in claim 1 further comprising a timing circuit coupled to receive the horizontal clock signal and coupled to supply the selector circuit with an adjustable timing signal that is generated in synchronization with the start of the horizontal clock signal, wherein the adjustable timing signal is used to time multiplex the first and second voltage signals.

6. A field emission display device as described in claim 5 wherein the timing circuit is a one-shot circuit and the length of the adjustable timing signal is based on an adjustable resistor network coupled to the one-shot circuit.

7. A field emission display device as described in claim 1 wherein the column drivers comprise red, blue and blue column drivers and further comprising:

a red timing circuit coupled to receive the horizontal clock signal and coupled to supply selector circuits of the red column drivers with a red adjustable timing signal that is generated in synchronization with the start of the horizontal clock signal;

a blue timing circuit coupled to receive the horizontal clock signal and coupled to supply selector circuits of the blue column drivers with a blue adjustable timing signal that is generated in synchronization with the start of the horizontal clock signal; and a blue timing circuit coupled to receive the horizontal clock signal and coupled to supply selector circuits of the blue column drivers with a blue adjustable timing signal that is generated in synchronization with the start of the horizontal clock signal, wherein the red, blue and blue adjustable timing signals are used, respectively, to time multiplex the first and second voltage signals for the red, blue and blue column drivers.

8. A field emission display device comprising:

a resistor chain for providing voltage taps;

a plurality of column drivers each coupled to a respective column and for driving voltage signals over the respective column line;

a plurality of row drivers each coupled to a respective row line, the plurality of row drivers for driving a row voltage signal over one row line at a time, wherein a pixel is comprised of intersections of one row line and at least three column lines; and a horizontal synchronization clock signal for synchronizing the refresh of individual row lines by initiating a row on-time pulse window; and wherein each of the column drivers comprises:

a digital to analog converter coupled to the resistor chain and for receiving color data and supplying a first voltage signal representative of the color data and for supplying a second voltage signal representative of the color data; and a selector circuit coupled to receive the first and second voltage signals and coupled to receive an adjustable timing signal, the selector circuit for performing color balancing by time multiplexing the first and second voltage signals on the respective column line within the row on-time pulse window, wherein the first voltage is applied in coincidence with the adjustable timing signal and the second voltage signal is applied thereafter.

9. A field emission display device as described in claim 8 wherein the digital to analog converter contains a first data-in voltage-out function stored therein that corresponds to color intensity of a first level.

10. A field emission display device as described in claim 9 wherein the digital to analog converter further contains a second data-in voltage-out function stored therein that corresponds to color intensity of a second level, the second level being less than the first level.

11. A field emission display device as described in claim 10 wherein the first level is 100 percent intensity and wherein the second level is 50 percent intensity.

12. A field emission display device as described in claim 8 further comprising a timing circuit coupled to receive the horizontal clock signal and coupled to supply the selector circuit with the adjustable timing signal, the adjustable timing signal generated in synchronization with the start of the horizontal clock signal.

13. A field emission display device as described in claim 12 wherein the timing circuit is a one-shot circuit and a period of the adjustable timing signal is based on an adjustable resistor network coupled to the one-shot circuit.

14. A field emission display device as described in claim 8 wherein the column drivers comprise red, blue and blue column drivers and further comprising:

a red timing circuit coupled to receive the horizontal clock signal and coupled to supply selector circuits of the red column drivers with a red adjustable timing signal that is generated in synchronization with the start of the horizontal clock signal;

a blue timing circuit coupled to receive the horizontal clock signal and coupled to supply selector circuits of the blue column drivers with a blue adjustable timing signal that is generated in synchronization with the start of the horizontal clock signal; and a blue timing circuit coupled to receive the horizontal clock signal and coupled to supply selector circuits of the blue column drivers with a blue adjustable timing signal that is generated in synchronization with the start of the horizontal clock signal, wherein the red, blue and blue adjustable timing signals are used, respectively, to time multiplex the first and second voltage signals for the red, blue and blue column drivers.

15. In a field emission display device, a circuit for adjusting color balance of the display comprising:

a resistor chain for providing voltage taps;

a plurality of column drivers each coupled to a respective column line and for receiving digital color data and for driving voltage signals over the respective column line;

a plurality of row drivers each coupled to a respective row line, the plurality of row drivers for driving a row voltage signal over one row line at a time; and a horizontal synchronization clock signal for synchronizing the refresh of individual row lines by initiating a row on-time pulse window; and wherein each of the column drivers comprises:

a digital to analog converter coupled to the resistor chain for receiving the digital color data and for using a first data-in voltage-out function for supplying a first voltage signal representative of the digital color data and for using a second data-in voltage-out function for supplying a second voltage signal representative of the digital color data; and a selector circuit coupled to receive the first and second voltage signals and coupled to receive an adjustable timing signal, the selector circuit for performing color balancing by time multiplexing the first and second voltage signals on the respective column line, wherein the first voltage is applied in coincidence with the adjustable timing signal and the second voltage signal is applied thereafter.

16. A circuit for adjusting color balance as described in claim 15 wherein the first function corresponds to color intensity of a first level and wherein the second function corresponds to color intensity of a second level, the second level being less than the first level.

17. A circuit for adjusting color balance as described in claim 16 wherein the first level is up to 100 percent intensity and wherein the second level is up to 50 percent intensity.

18. A circuit for adjusting color balance as described in claim 15 further comprising a timing circuit coupled to receive the horizontal clock signal and coupled to supply the selector circuit with the adjustable timing signal, the adjustable timing signal generated in synchronization with the start of the horizontal clock signal and applicable for all column drivers of a particular color.

19. A circuit for adjusting color balance as described in claim 18 wherein the timing circuit is a one-shot circuit and a period of the adjustable timing signal is based on an adjustable resistor network coupled to the one-shot circuit.

20. A circuit for adjusting color balance as described in claim 15 wherein the column drivers comprise red, blue and blue column drivers and further comprising:

a red timing circuit coupled to receive the horizontal clock signal and coupled to supply selector circuits of the red column drivers with a red adjustable timing signal that is generated in synchronization with the start of the horizontal clock signal;

a blue timing circuit coupled to receive the horizontal clock signal and coupled to supply selector circuits of the blue column drivers with a blue adjustable timing signal that is generated in synchronization with the start of the horizontal clock signal; and a blue timing circuit coupled to receive the horizontal clock signal and coupled to supply selector circuits of the blue column drivers with a blue adjustable timing signal that is generated in synchronization with the start of the horizontal clock signal, wherein the red, blue and blue adjustable timing signals are used, respectively, to time multiplex the first and second voltage signals for the red, blue and blue column drivers.

* * * * *